US011771178B1

(12) United States Patent
Wu

(10) Patent No.: US 11,771,178 B1
(45) Date of Patent: Oct. 3, 2023

(54) SHOELACE

(71) Applicant: JHIH HUEI TRADING CO., LTD., Changhua County (TW)

(72) Inventor: Yung-Yu Wu, Changhua County (TW)

(73) Assignee: JHIH HUEI TRADING CO., LTD., Changhua County (TW)

( * ) Notice: Subject to any disclaimer, the term of this patent is extended or adjusted under 35 U.S.C. 154(b) by 0 days.

(21) Appl. No.: 17/751,396

(22) Filed: May 23, 2022

(51) Int. Cl.
*A43C 9/00* (2006.01)

(52) U.S. Cl.
CPC ..... *A43C 9/00* (2013.01)

(58) Field of Classification Search
CPC ..... A43C 9/00
See application file for complete search history.

(56) References Cited

U.S. PATENT DOCUMENTS 2,477,151 A * 7/1949 Stapleton ..... A43C 9/00 24/713
4,306,410 A * 12/1981 Nakamura ..... D02G 3/38 428/377
4,858,282 A * 8/1989 DuPont, Jr. ..... A43C 9/00 24/712
5,272,796 A * 12/1993 Nichols ..... D04C 1/12 24/712
5,673,546 A * 10/1997 Abraham ..... A43C 9/00 87/3
6,796,008 B1 * 9/2004 Huang ..... A43C 9/00 24/712.1
2004/0216799 A1 * 11/2004 Tseng ..... A43C 9/00 139/421
2012/0144631 A1 * 6/2012 Stanev ..... D04C 1/12 24/712
2014/0256202 A1 * 9/2014 Laurent ..... D06H 5/002 442/304

* cited by examiner

*Primary Examiner* — David M Upchurch
(74) *Attorney, Agent, or Firm* — MUNCY, GEISSLER, OLDS & LOWE, P.C.

(57) ABSTRACT

A shoelace is provided, including: a core material, defining an axial direction; and a cover layer, sleeved on the core material and being at least partially slidable axially relative to the core material, including a plurality of first strands and a plurality of meshes woven by the plurality of first strands, the core material partially exposed outwardly from the plurality of meshes.

9 Claims, 3 Drawing Sheets

SHOELACE

BACKGROUND OF THE INVENTION

Field of the Invention

The present invention relates to a shoelace.

Description of the Prior Art

A conventional shoelace is usually made by weaving a plurality of strands, which only allows limited variations on the appearance with different weaves or strand colors. To give different stretch rate of shoelaces, the change of the manufacturing process is needed or the different specifications of strands are used, so that it is hard to manufacture. Moreover, the conventional shoelace substantially has a smooth appearance with insufficient friction, which is easy to loosen when it is tied.

The present invention is, therefore, arisen to obviate or at least mitigate the above mentioned disadvantages.

SUMMARY OF THE INVENTION

An object of the present invention is to provide a shoelace, which stretch rate can be adjustable, and is aesthetic and not easy to loosen after tied.

To achieve the above and other objects, the shoelace is provided, including: a core material, defining an axial direction; and a cover layer, sleeved on the core material and being at least partially slidable axially relative to the core material, including a plurality of first strands and a plurality of meshes woven by the plurality of first strands, the core material partially exposed outwardly from the plurality of meshes.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
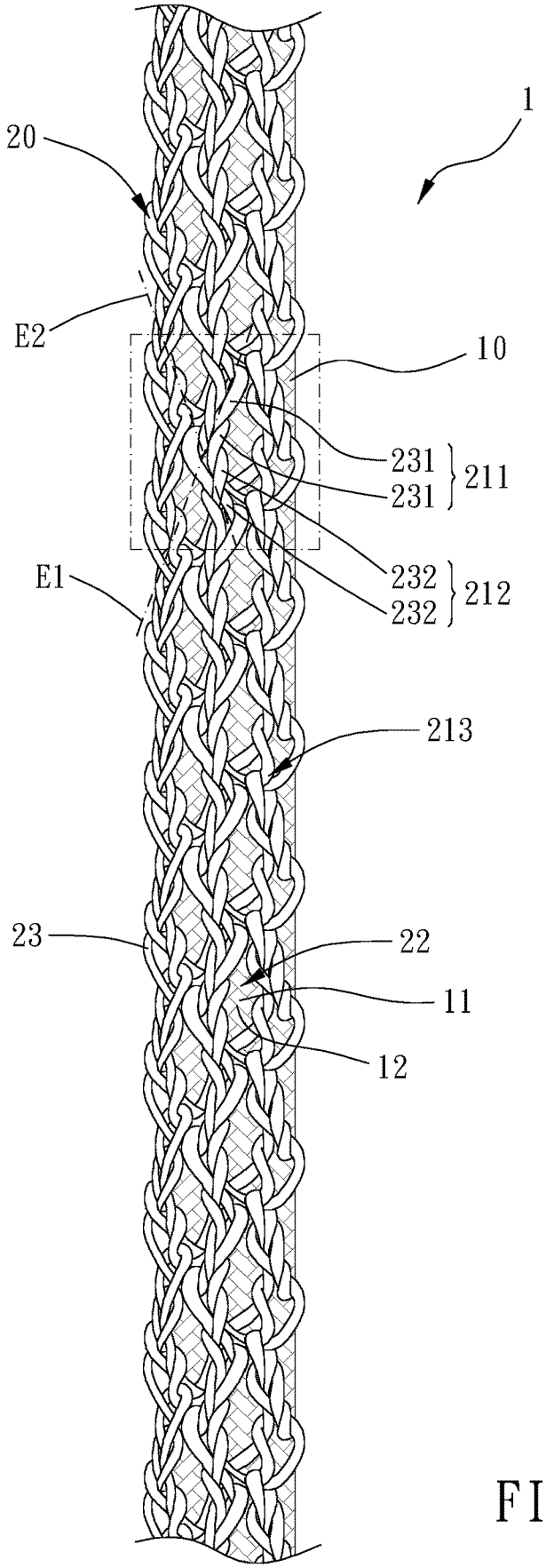
FIG. 1 is a perspective view of a shoelace according to a preferred embodiment of the present invention.
Figure 2:
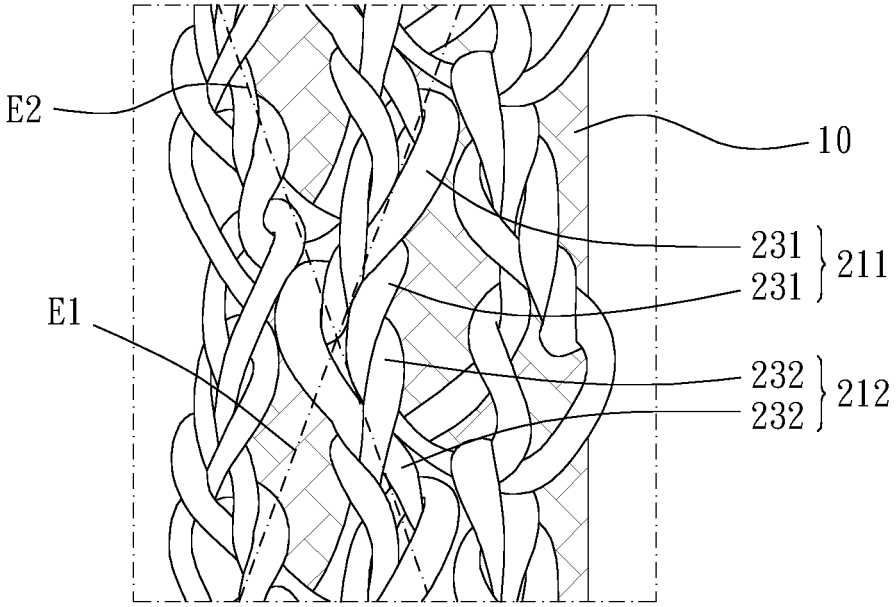
FIG. 2 is a partial-enlarged view of FIG. 1.
Figure 3:
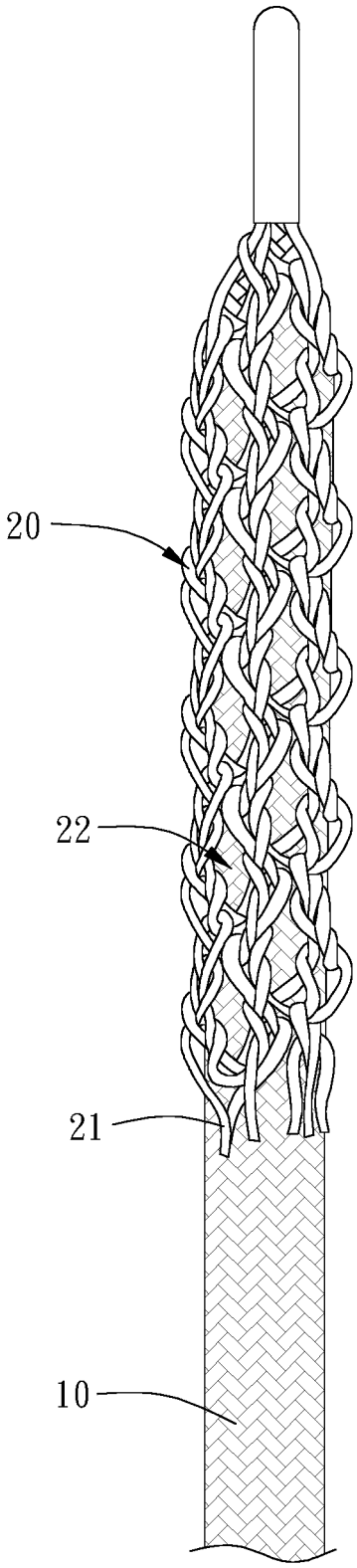
FIG. 3 is a drawing showing a cover layer which is unstretched of the preferred embodiment of the present invention.

FIGS. 1 to 4 show a shoelace according to a preferred embodiment of the present invention. The shoelace 1 includes a core material 10 and a cover layer 20.

The core material 10 defines an axial direction. The cover layer 20 is sleeved on the core material 10 and is at least partially slidable axially relative to the core material 10. The cover layer 20 includes a plurality of first strands 21 and a plurality of meshes 22 woven by the plurality of first strands 21, the core material 10 is partially exposed outwardly from the plurality of meshes 22. Therefore, the shoelace 1 has a concave-convex outer surface to show a special visual effect. Moreover, the shoelace 1 provides high friction so that it is not easy to loosen after tied. Furthermore, the cover layer 20 has a stretch allowance via the plurality of meshes 22 so that a stretch rate of the shoelace 1 is adjustable.

In this embodiment, the plurality of meshes 22 are continuously axially arranged, and adjacent two said meshes 22 are at least partially alternately arranged in a circumferential direction of the core material 10, so as to avoid increasing a thickness of the cover layer 20 when the cover layer 20 is compressed and overlapped; therefore, the shoelace 1 provides a sufficient stretch allowance. When the shoelace 1 is tied, the plurality of first strands 21 are partially embedded in the plurality of meshes 22 where parts of the cover layer 20 overlap against each other, and the cover layer 20 is movable relatively to the core material 10 by an outer force. However, the shoelace 1 cannot be easily to move by the outer force after tied, so that the shoelace 1 has great stability and is not easy to loosen after tied. However, the plurality of meshes 22 may be spaced arrangement.

Figure 4:
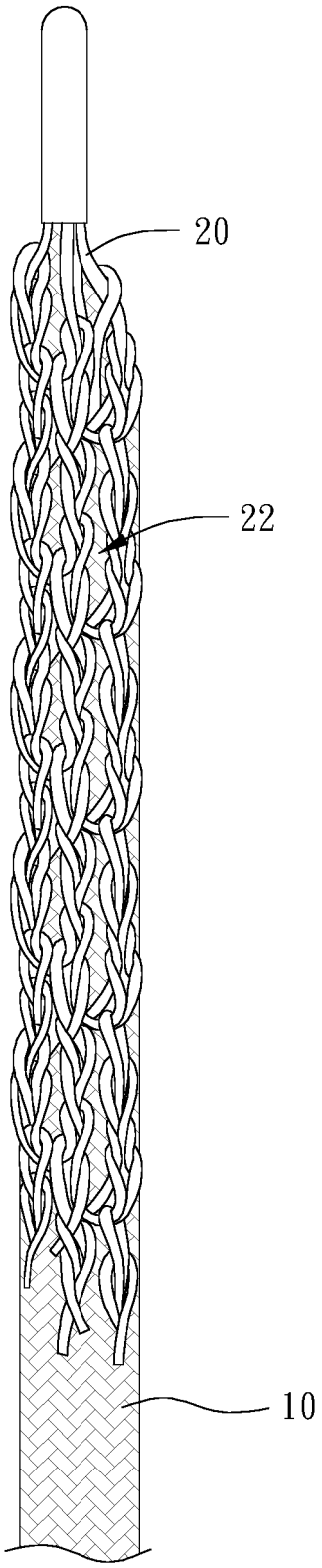
FIG. 4 is a drawing showing the cover layer of FIG. 3 which is stretched by an outer force.

The cover layer 20 is axially stretchable relatively to the core material 10 by the outer force, and a ratio range of length variations of the cover layer 20 before and after stretch to an unstretched length of the cover layer is 0.2 to 0.8. For example, if the unstretched length of the cover layer 20 is 2 centimeter, the cover layer 20 can be stretched to 2.5 centimeter or compressed to 1 centimeter. During manufacturing, an one end of the cover layer 20 disposed in the axial direction can be secured to the core material 10 via a shoelace head, a knot, adhesive, etc., and another end of the cover layer 20 is axially stretched (as shown in FIG. 4) or compressed relatively to the core material 10 to an expected length to be secured to the core material 10. For instance, if the core material 10 is a stretchable rope; and if the cover layer 20 is secured to the core material 10 after the cover layer 20 is stretched and tensed, the cover layer 20 cannot be further stretched; therefore the shoelace 1 has a small stretch rate and a good tensile strength. And if the cover layer 20 is secured to the core material 10 after the cover layer 20 is compressed, the cover layer 20 is stretchable with the core material 10, thus the stretch rate of the shoelace 1 is determined by the core material 10, so that a larger stretch rate is allowable. Moreover, the stretch rate is adjustable without changing the weaves or altering material.

In this embodiment, the core material 10 is woven by a plurality of second strands 11, the plurality of second strands 11 define a plurality of cross portions 12 on an outer surface of the core material 10, and the plurality of cross portions 12 at least partially correspond to the plurality of meshes 22, so as to provide a special visual effect. The core material 10 is a flat rope, a width of the flat rope is greater than an inner diameter size of the cover layer 20, and the flat rope is transversely folded to the axial direction, so as to provide sufficient friction force and a greater deformation allowance. However, the core material may be a round rope.

Specifically, the cover layer 20 is woven by the plurality of first strands 21 and form a plurality of loops 23, and a height of each said loop 23 is smaller than a length of one said mesh 22 in the axial direction. In this embodiment, the cover layer is made by warp knitting the plurality of first strands 21 together to form a plurality of loops 23 sleeved on each other. At least four said loops 23 define one said mesh 22, so as to provide high stretch rate. The plurality of first strands 21 extend back and forth in the circumferential direction to form a plurality of first extension sections 211 and a plurality of second extension sections 212 which are interlacedly arranged, and an extension direction E1 of each said first extension section 211 and an extension direction E2 of each said second extension section 212 are different and respectively inclined to the axial direction to form the plurality of meshes 22 with large openings. Each said first extension section 211 includes at least two first loops 231 sleeved on each other, each said second extension section 212 includes at least two second loops 232 sleeved on each other, and adjacent one said first loop 231 and one said second loop 232 are sleeved on each other and connected with one said first extension section 211 and one said second extension section 212 in the axial direction. The plurality of first extension sections 211 and the plurality of second extension sections 212 are circumferentially interlacedly arranged, so as to provide strong structural strength and an aesthetic appearance.

In this embodiment, a number of the plurality of first strands 21 is 6. The plurality of first strands 21 and the plurality of second strands 11 have different color, so as to provide an aesthetic appearance. Each said mesh 22 is formed by two said first extension sections 211 which correspond to each other and two said second extension sections 212 which correspond to each other. The at least two first loops 231 of each said first extension section 211 and the at least two second loops 232 of one said second extension section 212 circumferentially correspond to each other and are partially sleeved on each other to form a connection portion 213, and each said connection portion 213 is disposed between adjacent two said meshes 22, so as to provide strong strength structural and form special weaving patterns. In other embodiment, the plurality of first strands may include at least two different colors to provide various appearances.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A shoelace, including:

a core material, defining an axial direction; and a cover layer, sleeved on the core material and being at least partially slidable axially relative to the core material, including a plurality of first strands and a plurality of meshes woven by the plurality of first strands, the core material partially exposed outwardly from the plurality of meshes;

wherein the plurality of first strands extend back and forth in a circumferential direction of the core material to form a plurality of first extension sections and a plurality of second extension sections which are interlacedly arranged, and an extension direction of each said first extension section and an extension direction of each said second extension section are different and respectively inclined to the axial direction.

2. The shoelace of claim 1, wherein the cover layer is woven by the plurality of first strands and form a plurality of loops sleeved on each other, and a height of each said loop is smaller than a length of one said mesh in the axial direction.

3. The shoelace of claim 1, wherein each said first extension section includes at least two first loops sleeved on each other, each said second extension section includes at least two second loops sleeved on each other, and adjacent one said first loop and one said second loop are sleeved on each other and connected with one said first extension section and one said second extension section in the axial direction.

4. The shoelace of claim 3, wherein the at least two first loops of each said first extension section and the at least two second loops of one said second extension section circumferentially correspond to each other and are partially sleeved on each other to form a connection portion, and each said connection portion is disposed between adjacent two said meshes.

5. The shoelace of claim 1, wherein the plurality of meshes are continuously axially arranged, and adjacent two said meshes are at least partially alternately arranged in a circumferential direction of the core material.

6. The shoelace of claim 1, wherein the core material is woven by a plurality of second strands, the plurality of second strands define a plurality of cross portions on an outer surface of the core material, and the plurality of cross portions at least partially correspond to the plurality of meshes.

7. A shoelace, including:

a core material, defining an axial direction; and a cover layer, sleeved on the core material and being at least partially slidable axially relative to the core material, including a plurality of first strands and a plurality of meshes woven by the plurality of first strands, the core material partially exposed outwardly from the plurality of meshes;

wherein the core material is a flat rope, a width of the flat rope is greater than an inner diameter size of the cover layer, and the flat rope is transversely folded to the axial direction.

8. A shoelace, including:

a core material, defining an axial direction; and a cover layer, sleeved on the core material and being at least partially slidable axially relative to the core material, including a plurality of first strands and a plurality of meshes woven by the plurality of first strands, the core material partially exposed outwardly from the plurality of meshes;

wherein the cover layer is axially stretchable relatively to the core material by an outer force, and a ratio range of length variations of the cover layer before and after stretch to an unstretched length of the cover layer is 0.2 to 0.8.

9. A shoelace, including:

a core material, defining an axial direction; and a cover layer, sleeved on the core material and being at least partially slidable axially relative to the core material, including a plurality of first strands and a plurality of meshes woven by the plurality of first strands, the core material partially exposed outwardly from the plurality of meshes;

wherein the plurality of first strands extend back and forth in a circumferential direction of the core material to form a plurality of first extension sections and a plurality of second extension sections which are interlacedly arranged, and an extension direction of each said first extension section and an extension direction of each said second extension section are different and respectively inclined to the axial direction;

wherein each said first extension section includes at least two first loops sleeved on each other, each said second extension section includes at least two second loops sleeved on each other, and adjacent one said first loop and one said second loop are sleeved on each other and connected with one said first extension section and one said second extension section in the axial direction;

wherein the at least two first loops of each said first extension section and the at least two second loops of one said second extension section circumferentially correspond to each other and are partially sleeved on each other to form a connection portion, and each said connection portion is disposed between adjacent two said meshes;

wherein the plurality of first extension sections and the plurality of second extension sections are circumferentially interlacedly arranged; the cover layer is made by warp-knitting the plurality of first strands together to form a plurality of loops sleeved on each other, and a height of each said loop is smaller than a length of one said mesh in the axial direction; at least four said loops define one said mesh; the plurality of meshes are continuously axially arranged, and adjacent two said meshes are at least partially alternately arranged in a circumferential direction of the core material; the core material is woven by a plurality of second strands, the plurality of second strands define a plurality of cross portions on an outer surface of the core material, and the plurality of cross portions at least partially correspond to the plurality of meshes; the core material is a flat rope, a width of the flat rope is greater than an inner diameter size of the cover layer, and the flat rope is transversely folded to the axial direction; the cover layer is axially stretchable relatively to the core material by an outer force, and a ratio range of length variations of the cover layer before and after stretch to an unstretched length of the cover layer is 0.2 to 0.8; and a number of the plurality of first strands is 6; the plurality of first strands and the plurality of second strands have different color; each said mesh is formed by two said first extension sections which correspond to each other and two said second extension sections which correspond to each other.

* * * * *